US008079429B2

(12) United States Patent
Smith et al.

(10) Patent No.: US 8,079,429 B2
(45) Date of Patent: Dec. 20, 2011

(54) METHODS OF FORMING EARTH-BORING TOOLS USING GEOMETRIC COMPENSATION AND TOOLS FORMED BY SUCH METHODS

(75) Inventors: Redd H. Smith, The Woodlands, TX (US); John H. Stevens, Spring, TX (US); James L. Duggan, Friendswood, TX (US); Nicholas J. Lyons, Houston, TX (US); Jimmy W. Eason, The Woodlands, TX (US); Oliver Matthews, III, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 665 days.

(21) Appl. No.: 12/133,245

(22) Filed: Jun. 4, 2008

(65) Prior Publication Data

US 2009/0301786 A1 Dec. 10, 2009

(51) Int. Cl.
*E21B 10/36* (2006.01)
*B21K 5/04* (2006.01)

(52) U.S. Cl. ..... 175/425; 175/374; 76/108.2

(58) Field of Classification Search ..... 175/425, 175/374; 76/108.2
See application file for complete search history.

(56) References Cited

U.S. PATENT DOCUMENTS

| | | | |
|---|---|---|---|
| 2,244,053 | A | 6/1941 | Comstock |
| 4,244,432 | A | 1/1981 | Rowley et al. |
| 4,453,605 | A | 6/1984 | Short, Jr. |
| 4,774,211 | A | 9/1988 | Hamilton et al. |
| 5,061,439 | A | 10/1991 | Nyrhila et al. |
| 5,189,916 | A | 3/1993 | Mizumoto et al. |
| RE34,435 | E | 11/1993 | Warren et al. |
| 6,843,333 | B2 | 1/2005 | Richert et al. |
| 7,520,345 | B2 | 4/2009 | Sherwood, Jr. et al. |
| 7,594,554 | B2 | 9/2009 | Schwefe et al. |
| 2007/0102198 | A1 | 5/2007 | Oxford et al. |
| 2007/0102199 | A1 | 5/2007 | Smith et al. |
| 2007/0102200 | A1 | 5/2007 | Choe et al. |
| 2007/0102202 | A1 | 5/2007 | Choe et al. |

OTHER PUBLICATIONS

U.S. Appl. No. 11/635,432, filed Dec. 7, 2006 and entitled "Displacement Members and Methods of Using Such Displacement Members to Form Bit Bodies of Earth-Boring Rotary Drill Bits," Smith et al.
PCT International Search Report for International Application No. PCT/US2009/046091, dated Nov. 30, 2009.
Written Opinion of the International Searching Authority for International Application No. PCT/US2009/046091, dated Nov. 30, 2009.

*Primary Examiner* — Giovanna Wright
(74) *Attorney, Agent, or Firm* — TraskBritt

(57) ABSTRACT

Geometric compensation techniques are used to improve the accuracy by which features may be located on drill bits formed using particle compaction and sintering processes. In some embodiments, a positional error to be exhibited by at least one feature in a less than fully sintered bit body upon fully sintering the bit body is predicted and the at least one feature is formed on the less than fully sintered bit body at a location at least partially determined by the predicted positional error. In other embodiments, bit bodies of earth-boring rotary drill bits are designed to include a design drilling profile and a less than fully sintered bit body is formed including a drilling profile having a shape differing from a shape of the design drilling profile. Less than fully sintered bit bodies of earth-boring rotary drill bits are formed using such methods.

22 Claims, 15 Drawing Sheets

| Desired Final Design Cutting Element Pocket Positions | | | |
|---|---|---|---|
| Cutting Element Pocket Number | Blade | Radial Position (cm) | Longitudinal Position (cm) |
| 1 | 116 C | 1.5631 | 4.9875 |
| 2 | 116 A | 2.2342 | 5.3147 |
| 3 | 116 C | 3.0441 | 5.6492 |
| 4 | 116 A | 3.9057 | 5.9847 |
| 6 | 116 C | 4.6905 | 6.2469 |
| 8 | 116 D | 5.1880 | 6.4709 |
| 10 | 116 A | 5.6777 | 6.5232 |
| 12 | 116 B | 6.0991 | 6.5641 |
| 13 | 116 C | 6.5319 | 6.5334 |
| 15 | 116 D | 6.9581 | 6.4287 |
| 17 | 116 A | 7.3613 | 6.2532 |
| 19 | 116 B | 7.7274 | 6.0145 |
| 21 | 116 C | 7.9961 | 5.6576 |
| 23 | 116 D | 8.2584 | 5.3167 |
| 25 | 116 A | 8.4560 | 4.9479 |
| 27 | 116 B | 8.6055 | 4.5199 |
| 29 | 116 C | 8.7284 | 4.0927 |
| 31 | 116 D | 8.8306 | 3.6873 |
| 32 | 116 A | 8.9239 | 3.2591 |
| 33 | 116 B | 8.9780 | 2.8171 |
| 34 | 116 C | 8.9058 | 2.3711 |
| 35 | 116 D | 8.9058 | 1.9136 |
| 36 | 116 A | 8.9059 | 1.4803 |
| 37 | 116 B | 8.9058 | 0.9037 |

FIG. 6

| Uniformly Scaled Bit Body Cutting Element Pocket Positions | | | | | |
|---|---|---|---|---|---|
| Cutting Element Pocket Number | Blade | Radial Scale Factor | Radial Position (cm) | Longitudinal Scale Factor | Longitudinal Position (cm) |
| 1 | 116C | 1.1933 | 1.8653 | 1.1933 | 5.9516 |
| 2 | 116A | 1.1933 | 2.6661 | 1.1933 | 6.3420 |
| 3 | 116C | 1.1933 | 3.6326 | 1.1933 | 6.7412 |
| 4 | 116A | 1.1933 | 4.6606 | 1.1933 | 7.1416 |
| 6 | 116C | 1.1933 | 5.5972 | 1.1933 | 7.4546 |
| 8 | 116D | 1.1933 | 6.1909 | 1.1933 | 7.7216 |
| 10 | 116A | 1.1933 | 6.7752 | 1.1933 | 7.7842 |
| 12 | 116B | 1.1933 | 7.2780 | 1.1933 | 7.8329 |
| 13 | 116C | 1.1933 | 7.7945 | 1.1933 | 7.7966 |
| 15 | 116D | 1.1933 | 8.3030 | 1.1933 | 7.6714 |
| 17 | 116A | 1.1933 | 8.7842 | 1.1933 | 7.4623 |
| 19 | 116B | 1.1933 | 9.2211 | 1.1933 | 7.1773 |
| 21 | 116C | 1.1933 | 9.5417 | 1.1933 | 6.7512 |
| 23 | 116D | 1.1933 | 9.8548 | 1.1933 | 6.3445 |
| 25 | 116A | 1.1933 | 10.0906 | 1.1933 | 5.9044 |
| 27 | 116B | 1.1933 | 10.2690 | 1.1933 | 5.3937 |
| 29 | 116C | 1.1933 | 10.4156 | 1.1933 | 4.8839 |
| 31 | 116D | 1.1933 | 10.5375 | 1.1933 | 4.4002 |
| 32 | 116A | 1.1933 | 10.6489 | 1.1933 | 3.8891 |
| 33 | 116B | 1.1933 | 10.7135 | 1.1933 | 3.3617 |
| 34 | 116C | 1.1933 | 10.6273 | 1.1933 | 2.8294 |
| 35 | 116D | 1.1933 | 10.6273 | 1.1933 | 2.2836 |
| 36 | 116A | 1.1933 | 10.6274 | 1.1933 | 1.7665 |
| 37 | 116B | 1.1933 | 10.6273 | 1.1933 | 1.0784 |

FIG. 7

| Non-Uniformly Scaled Bit Body Cutting Element Pocket Positions Including Geometric Compensation | | | | | |
|---|---|---|---|---|---|
| Cutting Element Pocket Number | Blade | Radial Scale Factor ($F_R$) | Radial Position (cm) | Longitudinal Scale Factor ($F_L$) | Longitudinal Position (cm) |
| 1 | 116C | 1.2681 | 1.9822 | 1.2165 | 6.0673 |
| 2 | 116A | 1.2494 | 2.7913 | 1.2140 | 6.4519 |
| 3 | 116C | 1.2375 | 3.7671 | 1.2117 | 6.8454 |
| 4 | 116A | 1.2301 | 4.8045 | 1.2098 | 7.2401 |
| 6 | 116C | 1.2256 | 5.7488 | 1.2084 | 7.5487 |
| 8 | 116D | 1.2234 | 6.3471 | 1.2072 | 7.8120 |
| 10 | 116A | 1.2216 | 6.9357 | 1.2070 | 7.8737 |
| 12 | 116B | 1.2202 | 7.4420 | 1.2068 | 7.9217 |
| 13 | 116C | 1.2189 | 7.9619 | 1.2070 | 7.8859 |
| 15 | 116D | 1.2178 | 8.4736 | 1.2075 | 7.7625 |
| 17 | 116A | 1.2169 | 8.9576 | 1.2084 | 7.5562 |
| 19 | 116B | 1.2161 | 9.3970 | 1.2096 | 7.2752 |
| 21 | 116C | 1.2155 | 9.7193 | 1.2117 | 6.8552 |
| 23 | 116D | 1.2150 | 10.0340 | 1.2140 | 6.4544 |
| 25 | 116A | 1.2146 | 10.2709 | 1.2168 | 6.0207 |
| 27 | 116B | 1.2144 | 10.4502 | 1.2207 | 5.5177 |
| 29 | 116C | 1.2141 | 10.5975 | 1.2255 | 5.0156 |
| 31 | 116D | 1.2140 | 10.7199 | 1.2311 | 4.5394 |
| 32 | 116A | 1.2138 | 10.8318 | 1.2385 | 4.0363 |
| 33 | 116B | 1.2137 | 10.8967 | 1.2486 | 3.5174 |
| 34 | 116C | 1.2138 | 10.8102 | 1.2626 | 2.9939 |
| 35 | 116D | 1.2138 | 10.8101 | 1.2840 | 2.4571 |
| 36 | 116A | 1.2138 | 10.8102 | 1.3165 | 1.9488 |
| 37 | 116B | 1.2138 | 10.8101 | 1.4082 | 1.2726 |

FIG. 11

METHODS OF FORMING EARTH-BORING TOOLS USING GEOMETRIC COMPENSATION AND TOOLS FORMED BY SUCH METHODS

FIELD OF THE INVENTION

The present invention generally relates to earth-boring drill bits and other earth-boring tools that may be used to drill subterranean formations, and to methods of manufacturing such drill bits and tools. More particularly, the present invention relates to methods of forming earth-boring tools using geometric compensation to account for shrinkage during sintering and other material consolidation processes, and to tools formed using such methods.

BACKGROUND OF THE INVENTION

The depth of well bores being drilled continues to increase as the number of shallow depth hydrocarbon-bearing earth formations continues to decrease. These increasing well bore depths are pressing conventional drill bits to their limits in terms of performance and durability. Several drill bits are often required to drill a single well bore, and changing a drill bit on a drill string can be both time consuming and expensive.

In efforts to improve drill bit performance and durability, new materials and methods for forming drill bits and their various components are being investigated. For example, methods other than conventional infiltration processes are being investigated to form bit bodies comprising particle-matrix composite materials. Such methods include forming bit bodies using powder compaction and sintering techniques. The term "sintering," as used herein, means the densification of a particulate component and involves removal of at least a portion of the pores between the starting particles, accompanied by shrinkage, combined with coalescence and bonding between adjacent particles. Such techniques are disclosed in U.S. patent application Ser. No. 11/271,153, filed Nov. 10, 2005, now U.S. Pat. No. 7,802,495, issued Sep. 28, 2010, and U.S. patent application Ser. No. 11/272,439, also filed Nov. 10, 2005, now U.S. Pat. No. 7,776,256, issued Aug. 17, 2010, both of which are assigned to the assignee of the present invention, and the entire disclosure of each of which is incorporated herein by this reference.

An example of a bit body 50 that may be formed using such powder compaction and sintering techniques is illustrated in FIG. 1. The bit body 50 may be predominantly comprised of a particle-matrix composite material 54. As shown in FIG. 1, the bit body 50 may include wings or blades 58 that are separated by junk slots 60, and a plurality of PDC cutting elements 62 (or any other type of cutting element) may be secured within cutting element pockets 64 on the face 52 of the bit body 50. The PDC cutting elements 62 may be supported from behind by buttresses 66, which may be integrally formed with the bit body 50. The bit body 50 may include internal fluid passageways (not shown) that extend between the face 52 of the bit body 50 and a longitudinal bore 56, which extends through the bit body 50. Nozzle inserts (not shown) also may be provided at the face 52 of the bit body 50 within the internal fluid passageways.

An example of a manner in which the bit body 50 may be formed using powder compaction and sintering techniques is described briefly below.

Referring to FIG. 2A, a powder mixture 68 may be pressed (e.g., with substantially isostatic pressure) within a mold or container 74. The powder mixture 68 may include a plurality of hard particles and a plurality of particles comprising a matrix material. Optionally, the powder mixture 68 may further include additives commonly used when pressing powder mixtures such as, for example, organic binders for providing structural strength to the pressed powder component, plasticizers for making the organic binder more pliable, and lubricants or compaction aids for reducing inter-particle friction and otherwise providing lubrication during pressing.

The container 74 may include a fluid-tight deformable member 76 such as, for example, a deformable polymeric bag and a substantially rigid sealing plate 78. Inserts or displacement members 79 may be provided within the container 74 for defining features of the bit body 50 such as, for example, a longitudinal bore 56 (FIG. 1) of the bit body 50. The sealing plate 78 may be attached or bonded to the deformable member 76 in such a manner as to provide a fluid-tight seal therebetween.

The container 74 (with the powder mixture 68 and any desired displacement members 79 contained therein) may be pressurized within a pressure chamber 70. A removable cover 71 may be used to provide access to the interior of the pressure chamber 70. A fluid (which may be substantially incompressible) such as, for example, water, oil, or gas (such as, for example, air or nitrogen) is pumped into the pressure chamber 70 through an opening 72 at high pressures using a pump (not shown). The high pressure of the fluid causes the walls of the deformable member 76 to deform, and the fluid pressure may be transmitted substantially uniformly to the powder mixture 68.

Pressing of the powder mixture 68 may form a green (or unsintered) body 80 shown in FIG. 2B, which can be removed from the pressure chamber 70 and container 74 after pressing.

The green body 80 shown in FIG. 2B may include a plurality of particles (hard particles and particles of matrix material) held together by interparticle friction forces and an organic binder material provided in the powder mixture 68 (FIG. 2A). Certain structural features may be machined in the green body 80 using conventional machining techniques including, for example, turning techniques, milling techniques, and drilling techniques. Hand-held tools also may be used to manually form or shape features in or on the green body 80. By way of example and not limitation, blades 58, junk slots 60 (FIG. 1), and other features may be machined or otherwise formed in the green body 80 to form a partially shaped green body 84 shown in FIG. 2C.

The partially shaped green body 84 shown in FIG. 2C may be at least partially sintered to provide a brown (partially sintered) body 90 shown in FIG. 2D, which has less than a desired final density. Partially sintering the green body 84 to form the brown body 90 may cause at least some of the plurality of particles to have at least partially grown together to provide at least partial bonding between adjacent particles. The brown body 90 may be machinable due to the remaining porosity therein. Certain structural features also may be machined in the brown body 90 using conventional machining techniques and hand-held tools.

By way of example and not limitation, internal fluid passageways (not shown), cutting element pockets 64, and buttresses 66 (FIG. 1) may be machined or otherwise formed in the brown body 90 to form a brown body 96 shown in FIG. 2E. The brown body 96 shown in FIG. 2E then may be fully sintered to a desired final density, and the cutting elements 62 may be secured within the cutting element pockets 64 to provide the bit body 50 shown in FIG. 1.

In other methods, the green body 80 shown in FIG. 2B may be partially sintered to form a brown body without prior machining, and all necessary machining may be performed on the brown body prior to fully sintering the brown body to a desired final density. Alternatively, all necessary machining may be performed on the green body 80 shown in FIG. 2B, which then may be fully sintered to a desired final density.

As sintering (such as sintering of powder mixture 68 (FIG. 2A) to form brown body 96 (FIG. 2E)) involves densification and removal of porosity within a structure, the structure being sintered will shrink during a sintering process. As a result, dimensional shrinkage may need to be considered and accounted for when designing tooling (molds, dies, etc.) or machining features in structures that are less than fully sintered.

The positions of the cutting elements 62, which are secured within the cutting element pockets 64, relative to one another and to the bit body 50 are critical to performance of the drill bit (e.g., bit stability, durability, and rate of penetration) during drilling operations. If the cutting element pockets 64 are not properly located on the bit body 50, the performance of the drill bit may be negatively affected.

For example, if a cutting element 62 protrudes as little as 2.54 millimeters (one-tenth of an inch (1/10")) beyond the design position, that particular cutting element 62 may be exposed to an increased workload and increased forces during drilling. Such increased workload and forces may lead to early failure of the cutting element 62 and possibly the entire drill bit.

Furthermore, when the cutting elements 62 are displaced from their designed positions they may cause dynamic stability and performance problems. For example, cutting elements 62 that are displaced from their design positions may cause a drill bit to rotate about a rotational axis offset from the longitudinal axis of the drill bit in such a way that the drill bit tends to wobble or "whirl" in the borehole. This whirling may cause the center of rotation to change dramatically as the drill bit rotates within the borehole. Thus, the cutting elements 62 may travel faster, sideways, and contact the wellbore at undesired angles and locations and thus may be subject to greatly increased impact loads that may cause the failure of the cutting elements 62.

The positions of the cutting element pockets 64 relative to one another and to the bit body 50 may change during a sintering process, such as that described above, as the bit body 50 shrinks. In other words, for a given desired final bit design, if the corresponding green or brown bit body is formed according to uniformly scaled dimensions of the final bit design, the relative positions of the cutting element pockets 64 on the constructed bit body 50 may not accurately correspond to the design of the bit body. Additional machining of the bit body 50 (FIG. 1) in the fully sintered state may be required in some cases to account for the error in the position of the cutting element pockets 64 due to shrinking during sintering. However, machining of the bit body 50 (FIG. 1) in the fully sintered state may be difficult due to the hardness, wear-resistant and abrasive properties of the particle-matrix composite material 54 from which the bit body 50 is formed. Such shrinkage during sintering may be encountered with features of the bit body 50 other than cutting element pockets 64 such as, for example, fluid courses, nozzle recesses, junk slots, etc.

BRIEF SUMMARY OF THE INVENTION

In some embodiments, the present invention includes methods of forming bit bodies of earth-boring rotary drill bits by predicting the positional error to be exhibited by at least one feature of a plurality of features in a less than fully sintered bit body upon sintering the less than fully sintered bit body to a desired final density. The methods may further include forming the at least one feature of the plurality of features on the less than fully sintered bit body at a location at least partially determined by the predicted positional error to be exhibited by the at least one feature of the plurality of features and sintering the less than fully sintered bit body to a desired final density.

In additional embodiments, the present invention includes methods of forming bit bodies of earth-boring rotary drill bits by designing a bit body having a design drilling profile, forming a drilling profile of a less than fully sintered bit body to have a shape differing from a shape of the design drilling profile, and sintering the less than fully sintered bit body to a desired final density.

In other embodiments, the present invention includes methods of designing less than fully sintered bit bodies for earth-boring rotary drill bits by estimating a positional error for each feature of a plurality of features of a bit body upon sintering a less than fully sintered bit body to a desired final density to form the bit body. The methods may further include specifying a location for each feature of the plurality of features in a design for the less than fully sintered bit body at least partially in consideration of the respective estimated positional error for each feature of the plurality of features.

In yet another embodiment, the present invention includes a less than fully sintered bit body of an earth-boring rotary drill bit including a drilling profile having a shape differing from a desired shape of a design drilling profile of a fully sintered bit body to be formed from the less than fully sintered bit body.

In yet additional embodiments, the present invention includes less than fully sintered bit bodies of earth-boring rotary drill bits having at least one recess located at a position on a face of the bit body scaled by a first factor from a design position for the at least one recess and a second recess located at a position on the face of the bit body scaled by a second factor from a design position for the second recess, the second factor differing from the first factor.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the description of the invention when read in conjunction with the accompanying drawings, in which:

FIG. 6 is a table showing the desired final radial and longitudinal positions of each of the cutting element pockets of the earth-boring rotary drill bit shown in FIG. 3;

FIG. 7 is a table showing the radial and longitudinal positions of the cutting element pockets shown in FIG. 6 uniformly scaled by approximately the linear shrinkage rate of the material of the bit body in which the cutting element pockets may be formed;

FIG. 11 is a table showing the radial and longitudinal positions of the cutting element pockets shown in FIG. 6 non-uniformly scaled using geometric compensation factors at least partially derived from the graphs shown in FIGS. 9 and 10;

DETAILED DESCRIPTION OF THE INVENTION

The illustrations presented herein are not meant to be actual views of any particular material, apparatus, system, or method, but are merely idealized representations which are employed to describe the present invention. Additionally, elements common between figures may retain the same numerical designation.

The inventors of the present invention have developed methods that utilize geometric compensation techniques to improve the accuracy by which cutting element pockets may be located on drill bits formed using particle compaction and sintering processes according to a predetermined drill bit design. Such methods and earth-boring rotary drill bits formed using such methods are described below with reference to FIGS. 3 through 14. As used herein, geometric compensation comprises the non-uniform scaling of a body (and/or features formed therein) having a density less than a desired final density to account for shrinkage that occurs during a sintering process.

Figure 3:
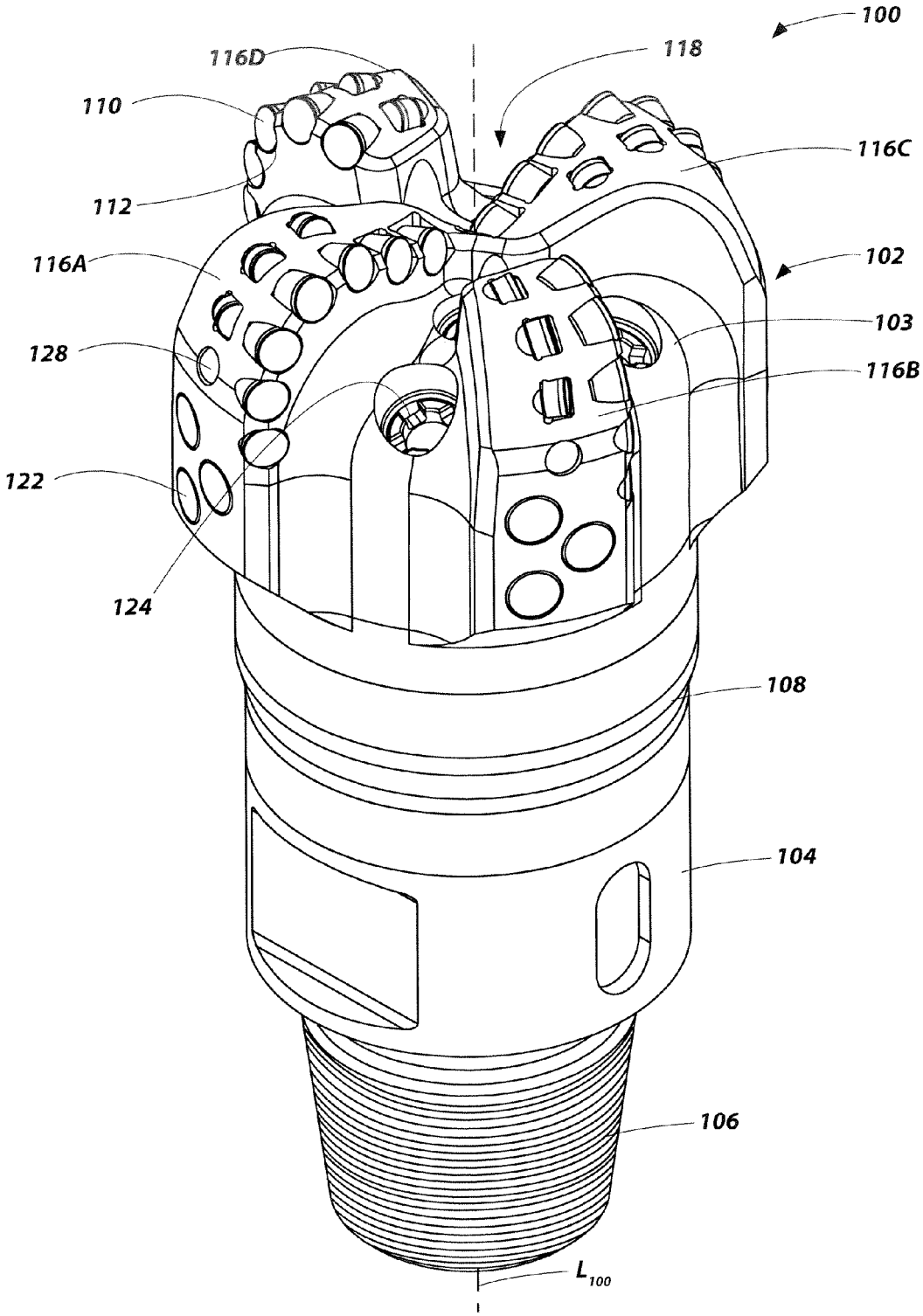
FIG. 3 is a perspective view of one embodiment of an earth-boring rotary drill bit of the present invention that includes cutting element pockets that have been formed using a geometric compensation process.

An embodiment of an earth-boring rotary drill bit 100 of the present invention is shown in FIG. 3. The earth-boring rotary drill bit 100 may comprise a bit body 102 that is secured to a shank 104 having a threaded connection portion 106 (e.g., an American Petroleum Institute (API) threaded connection portion) for attaching the drill bit 100 to a drill string (not shown). In some embodiments, such as that shown in FIG. 3, the bit body 102 may be secured to the shank 104 using an extension 108. In other embodiments, the bit body 102 may be secured directly to the shank 104.

Figure 1:
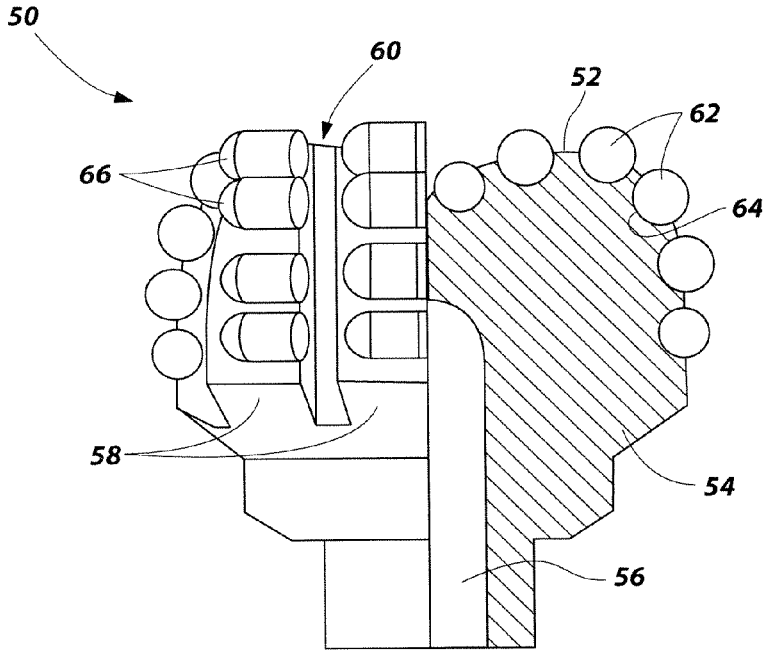
FIG. 1 is a partial longitudinal cross-sectional view of a bit body of an earth-boring rotary drill bit that may be formed using powder compaction and sintering processes.

The bit body 102 may include internal fluid passageways (not shown) that extend between the face 103 of the bit body 102 and a longitudinal bore (not shown), which extends through the shank 104, the extension 108, and partially through the bit body 102, similar to the longitudinal bore 56 shown in FIG. 1. Nozzle inserts 124 also may be provided at the face 103 of the bit body 102 within the internal fluid passageways. The bit body 102 may further include a plurality of blades 116A-116D that are separated by junk slots 118. In some embodiments, the bit body 102 may include gage pads 122 and wear knots 128. As one particular non-limiting example, the bit body 102 may include four blades 116A, 116B, 116C, 116D. A plurality of cutting elements 110 (which may include, for example, PDC cutting elements) may be mounted on the face 103 of the bit body 102 in cutting element pockets 112 that are located along each of the blades 116A, 116B, 116C, 116D.

Figure 2A:
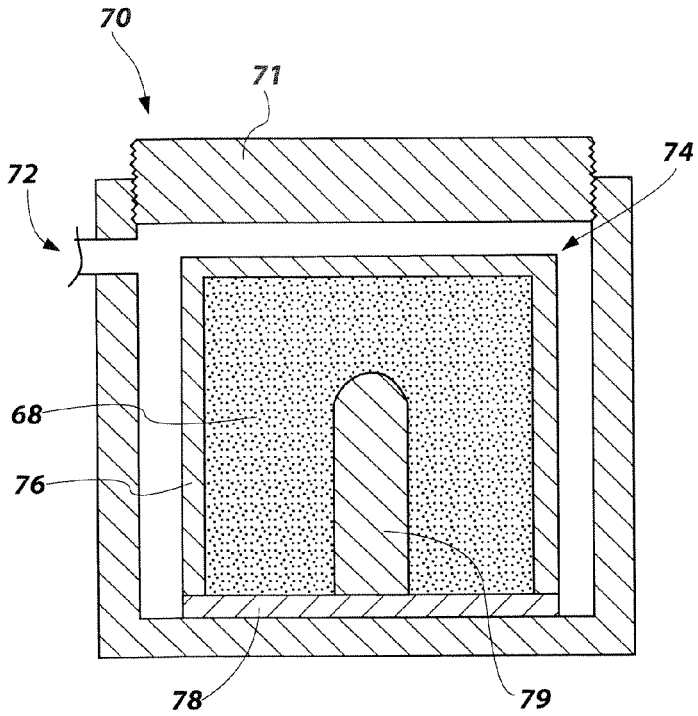
FIGS. 2A through 2E illustrate an example of a particle compaction and sintering process that may be used to form the bit body shown in FIG. 1.
Figure 2B:
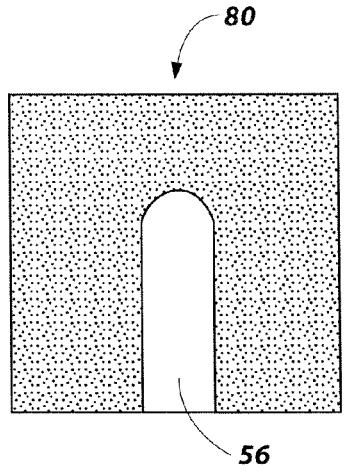
Figure 2C:
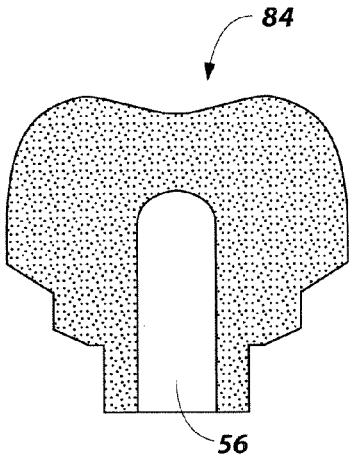
Figure 2D:
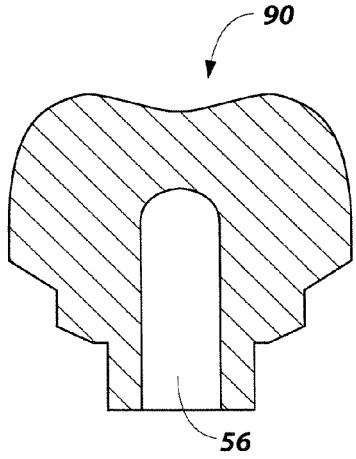
Figure 2E:
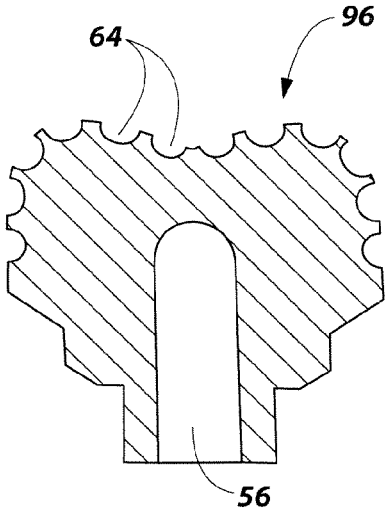
Figure 4:
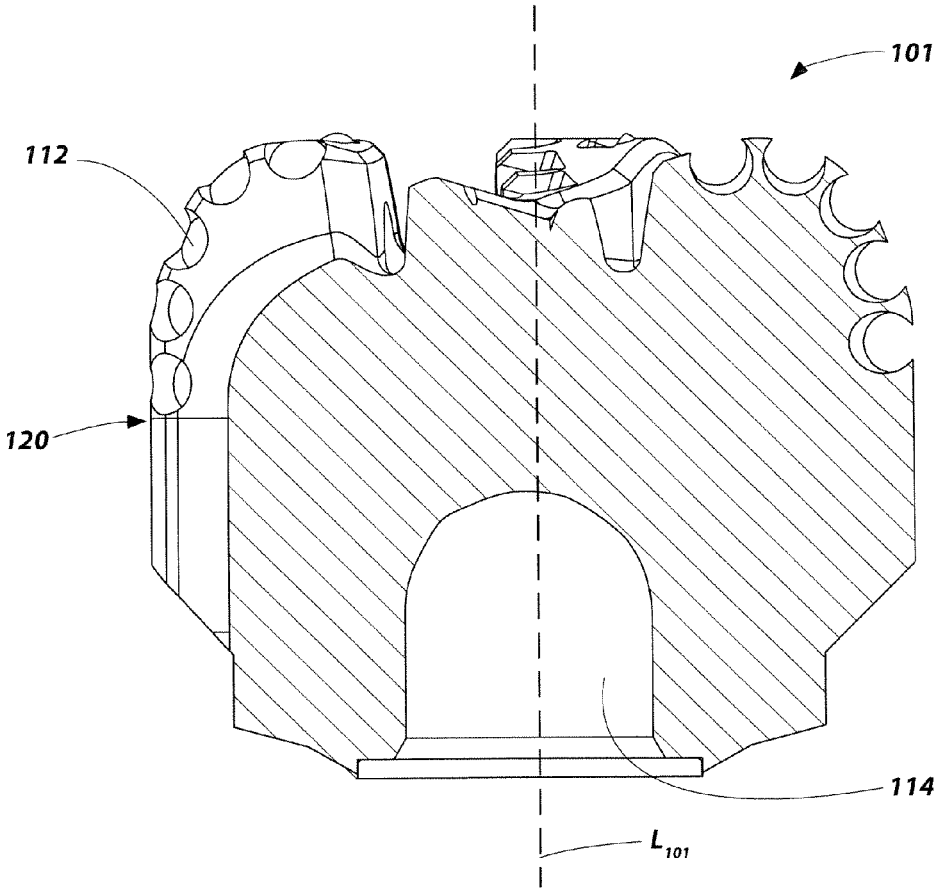
FIG. 4 is longitudinal cross-sectional view of one embodiment of a bit body having a density that is less than a desired final density and that may be sintered to form a bit body of the earth-boring rotary drill bit shown in FIG. 3.

The bit body 102 shown in FIG. 3 may comprise a particle-matrix composite material and may be formed using powder compaction and sintering processes, such as those described in previously mentioned U.S. patent application Ser. No. 11/271,153, filed Nov. 10, 2005, now U.S. Pat. No. 7,802,495, issued Sep. 28, 2010, and U.S. patent application Ser. No. 11/272,439, also filed Nov. 10, 2005, now U.S. Pat. No. 7,776,256, issued Aug. 17, 2010. FIG. 4 is a longitudinal cross-sectional view of a less than fully sintered bit body 101 (i.e., a green or brown bit body) that may be sintered to a desired final density to form the bit body 102. As shown in FIG. 4, cutting element pockets 112, a longitudinal bore 114, and other features may be formed in the bit body 101 prior to sintering it to desired final density, as described above in relation to bit body 96 (FIG. 2E).

Figure 5:
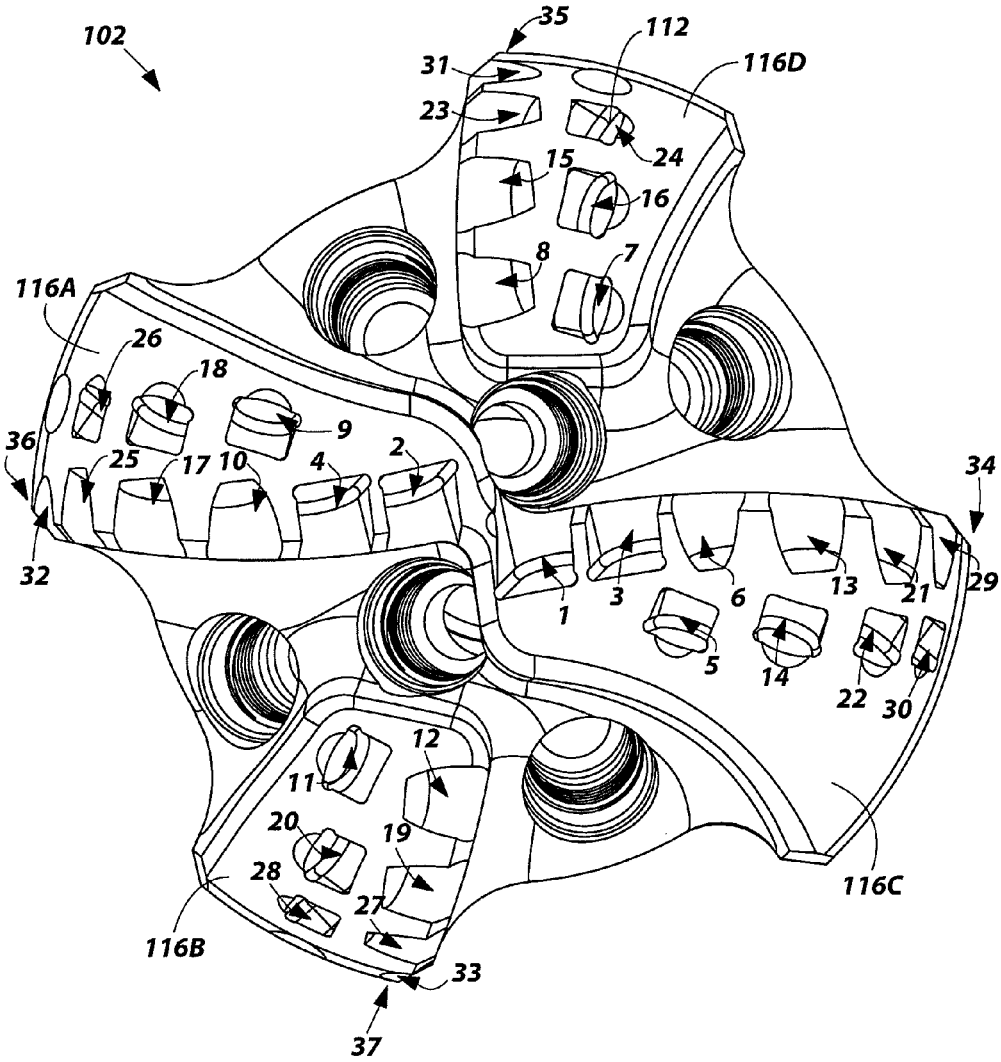
FIG. 5 is a plan view of the face of the earth-boring rotary drill bit shown in FIG. 3 without cutting elements or nozzle inserts thereon.

FIG. 5 is a top plan view of the face of the earth-boring rotary drill bit 102 shown in FIG. 3 without the cutting elements 110 or nozzle inserts 124 disposed thereon. As shown in FIG. 5, the cutting element pockets 112 may be located on the blades 116 at different locations relative to a longitudinal axis $L_{100}$ (FIG. 3) of the earth-boring rotary drill bit 100. The cutting element pockets 112 may be positioned relative to one another such that when cutting elements 110 are placed therein, the cutting elements 110 define a cutting profile that substantially covers the entire bottom surface of a bore hole when the earth-boring rotary drill bit 100 is disposed therein.

Each cutting element 110 on a drill bit 100 is conventionally referred to by a so-called "cutting element number," the cutting element 110 located (radially) closest to the longitudinal axis $L_{100}$ (FIG. 3) being assigned cutting element number 1, the second closest being assigned cutting element number 2, the third closest being assigned cutting element number 3, and so on. Although the cutting elements 110 are not shown in the cutting element pockets 112 in FIG. 5, each cutting element pocket 112 is labeled with a position number 1 through 37 corresponding to the cutting element number of the cutting element 110 to be positioned therein. In other words, the position of the cutting pocket 112 radially nearest the longitudinal axis $L_{100}$ may be referred to as position 1 and the position of the next radially closest cutting element pocket 112 to the longitudinal axis $L_{100}$ may be referred to as position 2, and so forth as shown in FIG. 5. As shown in FIG. 5, the cutting element pockets 112 may be positioned on the blades 116A, 116B, 116C, 116D in a generally spiral array. In other words, a line drawn on FIG. 5 sequentially through each of the cutting element pockets 112 from position 1 through position 37 would have a generally spiral configuration. Furthermore, the path swept by each cutting element 110 may partly overlap the paths swept by the adjacent cutting elements 110 located at slightly smaller and slightly greater radial distances from the longitudinal axis $L_{100}$.

As also shown in FIG. 5, the cutting elements 110 may comprise primary cutting elements (the cutting elements 110 secured within the cutting element pockets 112 located at positions 1, 2, 3, 4, 6, 8, 10, 12, 13, 15, 17, 19, 21, 23, 25, 27, 29, 31, 32, 33, 34, 35, 36, and 37) and secondary or backup cutting elements (the cutting elements 110 secured within the cutting element pockets 112 located at positions 5, 7, 9, 11, 14, 16, 18, 20, 22, 24, 26, 28, and 30).

Additionally, the position of each individual cutting element pocket 112 (and its associated cutting element 110) may be characterized in terms of a radial position, which may be the shortest distance from the longitudinal axis $L_{100}$ (FIG. 3) to the cutting element pocket 112, and in terms of a longitudinal position, which may be the shortest distance from a longitudinal reference plane (that is oriented perpendicular to the longitudinal axis $L_{100}$) to the cutting element pocket 112. For purposes of convenience, the longitudinal reference plane may be located at, for example, the uppermost point of a gage region 120 (FIG. 4) of the bit body 102.

The bit body 102 may be formed using powder compaction and sintering techniques as previously mentioned.

As sintering involves densification and removal of porosity within a structure, the structure being sintered will shrink during the sintering process. A structure may experience, for example, linear shrinkage of between 10% and 20% during sintering from a green state to a desired final density. As a result, dimensional shrinkage must be considered and accounted for when designing tooling (molds, dies, etc.) or when machining features in structures that are less than fully sintered.

To account for such dimensional shrinkage, a less than fully sintered bit body (e.g., the bit body 101 shown in FIG. 4) may be designed according to dimensions that have been uniformly scaled from the desired final dimensions of the bit body to be formed (e.g., the bit body 102 shown in FIG. 3). The dimensions may be uniformly scaled by a scaling factor that is determined by the linear shrinkage that is expected to be exhibited by the bit body during sintering. Furthermore, the location of any features to be machined into the bit body 101 also may be adjusted to accommodate for shrinkage during the sintering process. For example, the location or position of internal fluid passageways (not shown), cutting element pockets 112, and longitudinal bore 114 may all be uniformly scaled by the shrinkage rate of the powder mixture used to form the particle-matrix composite material to account for shrinkage during sintering.

As a non-limiting example, if the bit body exhibits a linear shrinkage rate of approximately nineteen percent (19%) as the less than fully sintered bit body 101 (FIG. 4) is sintered to a desired final density to form the final bit body 102 (FIG. 3), the linear dimensions of the less than fully sintered bit body 101, and the positions of the features to be formed therein, may be increased by a factor of approximately 1.19 from the design dimensions of the bit body 102 to account for dimensional shrinkage during sintering. As a non-limiting example, FIG. 6 is a table that includes the design or final desired radial and longitudinal positions of the primary cutting element pockets 112 of the bit body 102 shown in FIGS. 3 and 5. FIG. 7 contains the uniformly scaled radial and longitudinal positions of the primary cutting element pockets 112 to be formed into the less than fully sintered bit body 101 (FIG. 4). Both the radial and longitudinal positions of the cutting element pockets 112 in the less than fully sintered bit body 101, as shown in FIG. 7, have been scaled by a factor of approximately 1.19 (the approximate linear shrinkage rate for one particular, non-limiting embodiment of a bit body) from the design or desired final positions shown in FIG. 6 to account for shrinkage as the less than fully sintered bit body 101 (FIG. 4) is sintered to form the bit body 102 (FIG. 3). The particular radial scale factor and longitudinal scale factor for any particular bit body, however, will be at least partially a function of the bit design, the density of the bit body (green or brown) prior to sintering, and the desired final density of the bit body.

In some embodiments, the cutting element pockets 112 may be formed into the bit body 101 (FIG. 4) in the scaled positions (FIG. 7) using a multi-axis machine tool, such as a computer numerical control machine (CNC machine), and hand-held tools as necessary or desired. In yet additional embodiments, the cutting element pockets 112 may be integrally formed with the bit body 101. For example, in some embodiments, the cutting element pockets 112 may be formed in the bit body 101 by placing displacement members, similar to displacement member 79 shown in FIG. 2A, within a mold or deformable member (similar to deformable member 76) when pressing a powder mixture to form a green bit body.

When using a uniform scale factor to form the less than fully sintered bit body 101, the less than fully sintered bit body 101 may have a drilling profile (i.e., the profile defined by the face of the bit body in a longitudinal cross section taken through the longitudinal axis of the bit body) having the same shape as the shape of a desired final (i.e., design) drilling profile, only enlarged by the uniform scale factor.

By forming the cutting element pockets 112 into the less than fully sintered bit body 101 at positions scaled from their desired final positions by approximately the linear shrinkage factor that is exhibited by the bit body during sintering, the cutting element pockets 112 may shrink, be displaced, or move to approximately their desired design positions when the bit body 101 is sintered to a desired final density.

Figure 8:
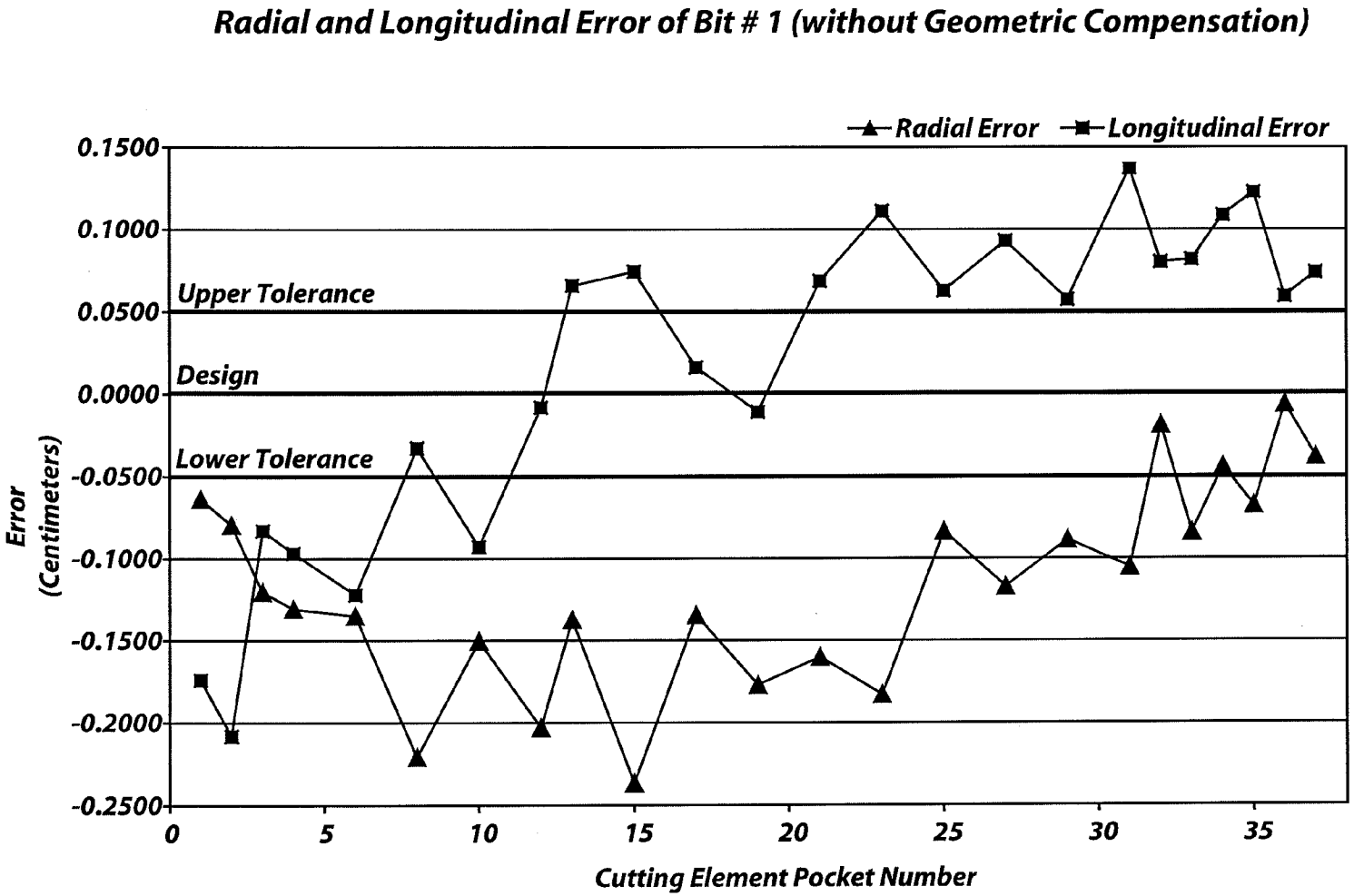
FIG. 8 is a graph illustrating the positional error of the primary cutting element pockets shown in FIG. 6 (i.e., the difference between the design or final desired positions of the primary cutting element pockets and the actual measured positions of the primary cutting element pockets) of a first actual drill bit in which the cutting element pockets were formed in a brown bit body at the locations specified in FIG. 7 and the brown bit body was then sintered to a desired final density.

Two actual bit bodies (Bit No. 1 and Bit No. 2) like the bit body 102 shown in FIG. 3 were fabricated by forming brown bit bodies like the less than fully sintered bit body 101 shown in FIG. 4 and having cutting element pockets 112 at the uniformly scaled radial and longitudinal positions shown in FIG. 7. The brown bit bodies 101 were sintered to a desired final density, and the actual radial positions and longitudinal positions of the primary cutting element pockets 112 in the fully sintered bit bodies 102 were measured using a coordinate measurement machine (CMM). After the actual radial positions and longitudinal positions of the primary cutting element pockets 112 were determined, the radial error for each cutting element pocket 112 was determined by subtracting the actual radial position from the design radial position (the desired final radial position), and the longitudinal error for each cutting element pocket 112 was determined by subtracting the actual longitudinal position from the design longitudinal position (the desired final longitudinal position). FIG. 8 is a graph illustrating both the radial error and the longitudinal error for each of the primary cutting element pockets 112 for one of the two fabricated bit bodies 102.

As shown in FIG. 8, there may be a desired upper tolerance level and a desired lower tolerance level for both the radial error and the longitudinal error for any particular bit body design. As one non-limiting example, the upper tolerance level may be 0.0500 centimeter and the lower tolerance level may be −0.0500 centimeter (i.e., a tolerance of +/−0.0500 centimeter). As shown in FIG. 8, a majority of the cutting element pockets 112 of the bit body 102 represented therein had a radial error and a longitudinal error outside the desired tolerance of +/−0.0500 centimeter. Furthermore, the radial error and the longitudinal error may vary in a non-uniform manner. In other words, the radial error and the longitudinal error of each cutting element pocket 112 may differ from the radial error and longitudinal error of at least one other cutting element pocket 112.

The positional error of each of the primary cutting element pockets 112 of the bit body 102 represented in FIG. 8 may be due to one or more parameters that affect shrinkage during sintering including, for example, variance in the size and distribution of the plurality of particles of the powder mixture used to form the green bit body, the pressing method used to form the green bit body, the compaction pressure, and the concentration of the organic binder in the green bit body. Furthermore, the positional error of each of the primary cutting element pockets 112 of the bit body 102 represented in FIG. 8 also may be due to the hollow and unsupported center of the bit body 101 that is formed by the longitudinal bore 114 (FIG. 4). Because the center of the bit body 101 may be unsupported during sintering, the cutting element pockets 112 and other features of the bit body 101 near the unsupported center of the bit body 101 may tend to slump or sink toward the center of the bit body 101 during sintering relatively more than the cutting element pockets 112 and other features of the bit body 101 remote from the center of the bit body 101. This difference in sinking or slumping that may occur during sintering between different regions of the bit body 101 may at least partially cause the positional error of the cutting element pockets 112.

In some embodiments of the present invention, geometrical compensation may be used to reduce the error in the position of cutting element pockets 112 formed in a bit body 102 fabricated using particle compaction and sintering techniques. The radial error and longitudinal error that are likely to occur for each cutting element pocket 112 of a bit body 102 during a sintering process may be determined or estimated, and the positions of each of the cutting element pockets 112 in the green or brown bit bodies may be non-uniformly scaled by scaling factors specific to each respective cutting element pocket 112.

Figure 9:
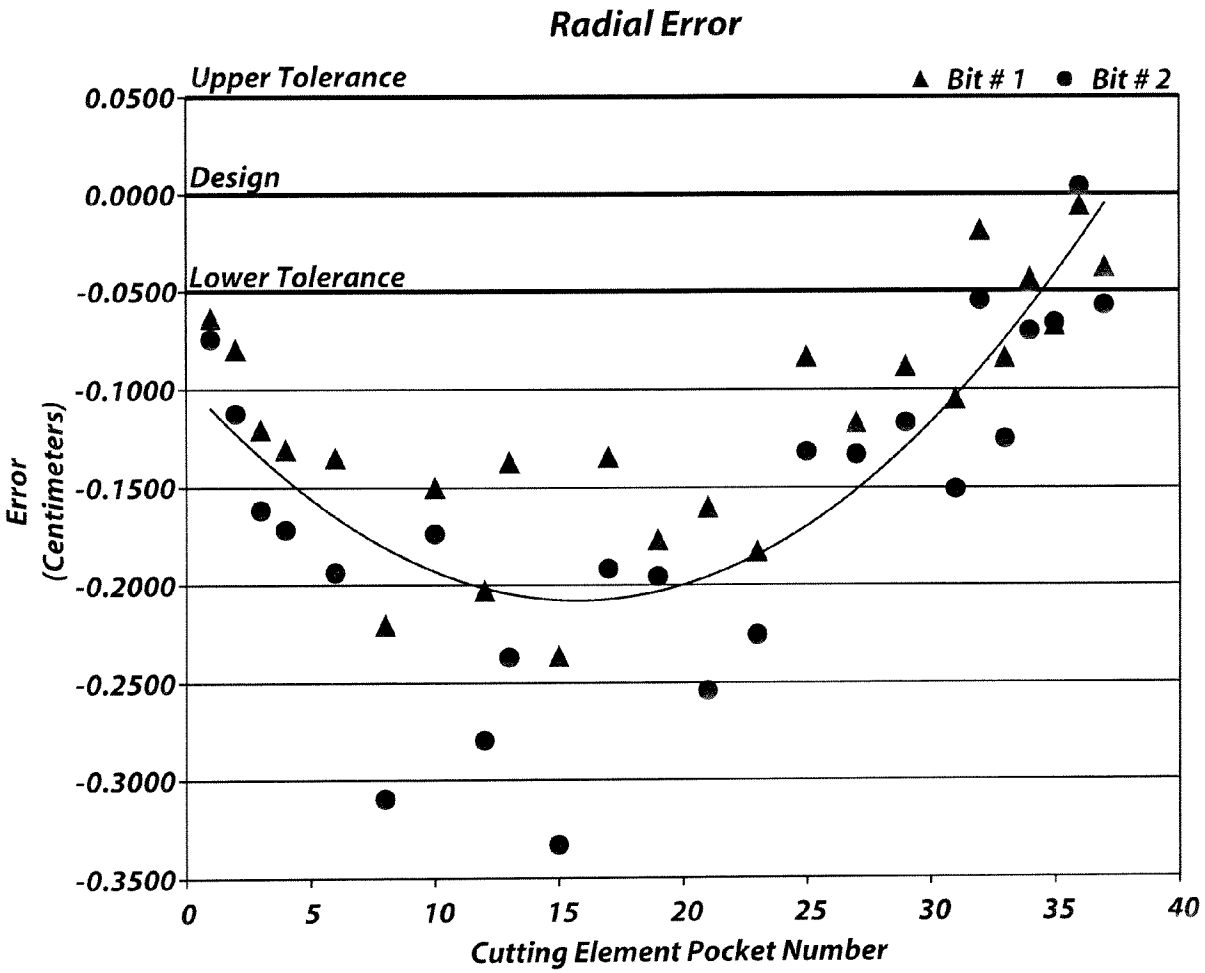
FIG. 9 is graph illustrating the radial positional error of the primary cutting element pockets shown in FIG. 6 for first and second actual drill bits in which the cutting element pockets were formed in brown bit bodies at the locations specified in FIG. 7 and the brown bit bodies were then sintered to the desired final density.

As previously mentioned, two actual bit bodies like the bit body 102 shown in FIG. 3 were fabricated by forming brown bit bodies like the less than fully sintered bit body 101 shown in FIG. 4 having cutting element pockets 112 at the uniformly scaled radial and longitudinal positions shown in FIG. 7. FIG. 9 is a graph of the radial error of the primary cutting element pockets 112 for each of these two bit bodies, and FIG. 10 is a graph illustrating the longitudinal error of the primary cutting element pockets 112 for each of these two bit bodies.

As shown in FIG. 9, the radial error of the primary cutting element pockets 112 generally follows a curved line or path (illustrated by the curved line in the field of the graph of FIG. 9). As shown in FIG. 10, the longitudinal error of the primary cutting element pockets 112 also generally follows a curved line or path (illustrated by the curved line in the field of the graph of FIG. 10). As also shown in FIG. 10, the longitudinal error that was exhibited by the two bit bodies after sintering may be greatest for the cutting element pockets closest to the longitudinal axis of the bit bodies.

Figure 10:
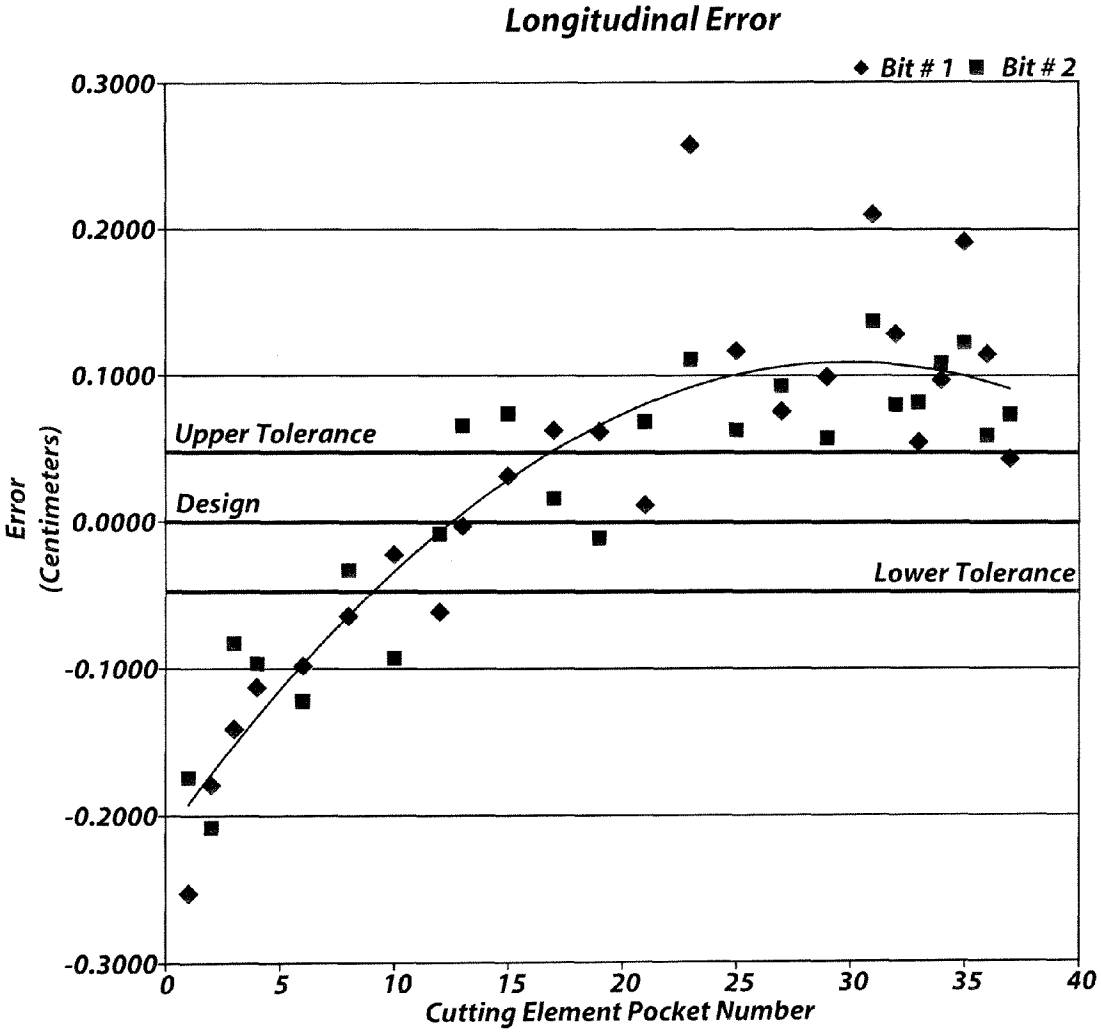
FIG. 10 is graph illustrating the longitudinal positional error of the primary cutting element pockets shown in FIG. 6 for first and second actual drill bits in which the cutting element pockets were formed in brown bit bodies at the locations specified in FIG. 7, the brown bit bodies then being sintered to the desired final density.

While the graphs of FIGS. 9 and 10 were determined empirically (i.e., by actually forming less than fully sintered bit bodies, sintering the bit bodies to a desired final density, and measuring the locations of the cutting element pockets in the fully sintered bit bodies), in additional methods of the present invention, graphs similar to those of FIGS. 9 and 10, which predict the positional error in a bit body after sintering to a desired final density, may be determined using computational modeling techniques.

These curved lines shown in FIGS. 9 and 10 may be used to predict or estimate the radial error and the longitudinal error for each of the cutting element pockets 112, and to non-uniformly scale the radial and longitudinal positions of the cutting element pockets 112 in the less than fully sintered bit body 101 in such a manner as to decrease the actual radial error and longitudinal error for each of the cutting element pockets 112. In other words, a specific radial scale factor and a specific longitudinal scale factor may be determined for each of the respective cutting element pockets 112 using the curved lines shown in FIGS. 9 and 10.

In some embodiments, numerical techniques known by those of ordinary skill in the art may be used to predict or estimate the radial error and the longitudinal error for each of the cutting element pockets 112, and to non-uniformly scale the radial and longitudinal positions of the cutting element pockets 112 in the less than fully sintered bit body 101 in such a manner as to decrease the actual radial error and longitudinal error for each of the cutting element pockets 112. For example, in one non-limiting embodiment, regression analysis may be used to fit a line to each of the curves represented by the data in FIGS. 9 and 10. Regression analysis was used to fit the curved lines shown in FIGS. 9 and 10 to the general curves of the data. The curve shown in FIG. 9 is defined by Equation (1):

$$R=0.0005x^2-0.0142x-0.096, \qquad \text{Equation (1)}$$

where x is the cutting element pocket number and R is the predicted radial error that will occur during sintering. Similarly, the curve shown in FIG. 10 is defined by Equation (2):

$$L=-0.0004x^2+0.0216x-0.2134 \qquad \text{Equation (2)}$$

where x is the cutting element pocket number and L is the predicted longitudinal error that will occur during sintering.

While the above formulas that define the trend lines shown in FIGS. 9 and 10 were obtained by using numerical regression techniques to fit a second degree polynomial to the average radial and longitudinal error or displacement, in other embodiments, other numerical techniques known by one of ordinary skill in the art may be used to characterize the cutting element pocket position error or displacement. Furthermore, in some embodiments, the numerical technique used to characterize the error or displacement of the locations of the cutting element pockets may depend on the nature of the data obtained through experimental measurements. For example, the nature of the data may determine whether a linear fit, a logarithmic fit, or any degree of polynomial fit is used.

One of ordinary skill in the art will recognize that there are many different ways and numerical methods by which the error or displacement of the locations of the cutting element pockets can be characterized and therefore anticipated. The above formulas and methods are used only as examples to aid in describing embodiments of the present invention and are non-limiting. For example, instead of being a variable of the cutting element pocket number, the equations may be a variable of the radial position of the cutting element pockets or a variable of the longitudinal position of the cutting element pockets.

As previously mentioned, once the specific (e.g., radial and longitudinal) positional error that is likely to occur for each of the respective cutting element pockets 112 upon uniform scaling of the dimensions to form the less than fully sintered bit body 101 (and subsequent sintering of the bit body to a final density) has been predicted or estimated, this data may be used to determine a specific radial scale factor and a specific longitudinal scale factor for each respective cutting element pocket 112. For example, a specific radial scale factor for each particular cutting element pocket 112 may be determined using Equation (3):

$$F_R=(SP_R+R)/DP_R, \quad \text{Equation (3)}$$

where $F_R$ is the specific radial scale factor for the particular cutting element pocket 112, $SP_R$ is the uniformly scaled radial position for that particular cutting element pocket 112 (e.g., from FIG. 7), R is the predicted radial error for that particular cutting element pocket 112, as defined by Equation (1) above, and $DP_R$ is the radial design position for that particular cutting element pocket 112 (e.g., from FIG. 6). Similarly, a specific longitudinal scale factor for each particular cutting element pocket 112 may be determined using Equation (4):

$$F_L=(SP_L+L)/DP_L, \quad \text{Equation (4)}$$

where $F_L$ is the specific longitudinal scale factor for the particular cutting element pocket 112, $SP_L$ is the uniformly scaled longitudinal position for that particular cutting element pocket 112 (e.g., from FIG. 7), L is the predicted longitudinal error for that particular cutting element pocket 112, as defined by Equation (2) above, and $DP_L$ is the longitudinal design position for that particular cutting element pocket 112 (e.g., from FIG. 6).

FIG. 11 is a table illustrating the specific radial scale factors $F_R$ and longitudinal scale factors $F_L$ for each of the primary cutting element pockets 112 of the less than fully sintered bit body 101 shown in FIG. 4, as estimated using Equations (1) through (4) above. The radial positions and longitudinal positions of the cutting element pockets 112 shown in FIG. 11 were non-uniformly scaled using the radial scale factors and longitudinal scale factors shown in FIG. 11, which were each specifically tailored or customized for each respective cutting element pocket 112. In contrast, the radial positions and longitudinal positions of the cutting element pockets 112 shown in FIG. 7 were uniformly scaled using a single, uniform scale factor (for both the radial scale factor and the longitudinal scale factor).

As discussed above, in embodiments of the present invention, the position of each primary cutting element pocket 112 in a less than fully sintered bit body 101 may be determined using scale factors that are specifically tailored for that respective cutting element pocket 112. In some embodiments, the position of each primary cutting element pocket 112 may be scaled by a different scale factor than the position of every other primary cutting element pocket 112. In other embodiments, at least some of the positions of the primary cutting element pockets 112 may be scaled by the same factor as other positions of primary cutting element pockets 112. Furthermore, as shown in FIG. 11, in some embodiments, the radial scale factor may differ from the longitudinal scale factor for the position of at least one primary cutting element pocket 112 to be formed into the bit body 101.

After the cutting element pockets have been formed in a less than fully sintered bit body 101 in their estimated, specifically tailored positions as determined using the principles discussed above, the bit body 101 may contain a plurality of cutting element pockets 112 each at a location scaled from a design or desired final position by a specifically tailored or customized scale factor. Furthermore, as previously mentioned, the radial scale factor by which each cutting element pocket 112 is radially scaled or offset from its final desired position may differ from the longitudinal scale factor by which that same cutting element pocket 112 is longitudinally scaled or offset from its final desired position.

Once the cutting element pockets 112 have been formed in the bit body 101 at positions non-uniformly offset from their design positions, the bit body 101 may be sintered to a desired final density. During such sintering, the position of the cutting element pockets 112 may move from their non-uniformly scaled, or geometrically compensated, positions to approximately their design or final desired positions. Furthermore, in some embodiments, the error or displacement of the cutting element pocket positions of a bit body 101 with non-uniformly offset or geometrically compensated cutting element pocket position, which has been sintered to a desired final density, may each fall within a desired tolerance.

Using embodiments of methods of the present invention, the less than fully sintered bit bodies may have a drilling profile (i.e., the profile defined by the face of the bit body in a longitudinal cross section taken through the longitudinal axis of the bit body) having a shape that differs from the shape of a drilling profile of the fully sintered bit body. Furthermore, the drilling profile of the less than fully sintered bit body may have a different shape from the shape of the desired final (i.e., design) drilling profile, and the shape of the drilling profile of the fully sintered bit body may substantially match the shape of the desired final drilling profile.

In additional embodiments, only some positions of the cutting element pockets 112 may be non-uniformly offset, while the positions of other cutting element pockets 112 may be uniformly offset.

In some embodiments of the present invention, non-uniform scale factors may be used to correct radial error and longitudinal error only for cutting element pockets 112 located proximate the longitudinal axis $L_{101}$ (FIG. 4) of the bit body 101 (e.g., cutting element pocket positions 1 through about 25). Thus, in some embodiments, the cutting element pockets on the gage region of the bit body and those otherwise located along the radial periphery of the bit body may be uniformly scaled from their design positions by a uniform scaling factor that is approximate or equal to the linear shrinkage rate exhibited by the bit body during sintering. Such cutting element pockets may not be displaced during sintering enough to cause them to fall outside a desired tolerance range. Therefore, for such cutting element pockets, uniform offset corrections may be used when forming their positions in a less than fully sintered bit body.

Figure 12:
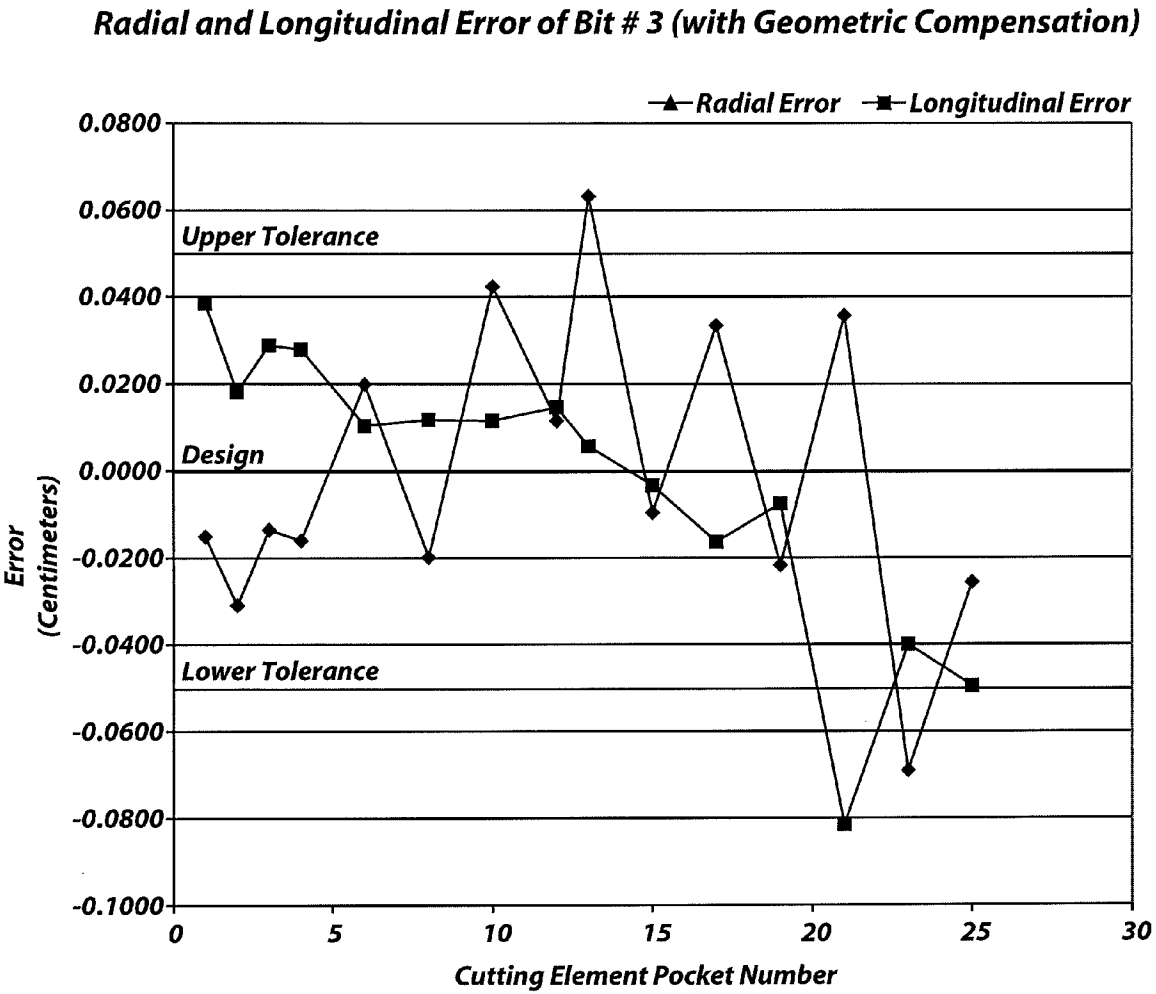
FIG. 12 is a graph illustrating the positional error of the primary cutting element pockets shown in FIG. 6 (i.e., the difference between the design or final desired positions of the primary cutting element pockets and the actual measured positions of the primary cutting element pockets) of a third actual drill bit in which the cutting element pockets were formed in a brown bit body at the locations non-uniformly scaled from the design position shown in FIG. 6, the brown bit body then being sintered to the desired final density.

FIG. 12 is a graph illustrating the measured radial error and longitudinal error for the positions of cutting element pockets 112 in positions 1 through 25 for an actual bit body similar to that shown in FIGS. 3 and 5 after forming cutting element pockets 112 in a less than fully sintered bit body 101, like that shown in FIG. 4, at non-uniformly scaled, or geometrically compensated, locations, and subsequently sintering the less than fully sintered bit body 101 to a desired final density. A comparison of FIGS. 12 and 8 shows that many more cutting element pockets 112 were located within the predetermined tolerance level of +/−0.0500 centimeter in the bit body formed using geometric compensation (FIG. 12) than in the bit body formed without using geometric compensation (FIG. 8). Therefore, considerable improvement may be achieved in accurate positioning of cutting element pockets 112 in a bit body 102 by employing the geometric compensation techniques previously described herein. In other words, by non-uniformly scaling the locations of cutting element pockets 112 in less than fully sintered bit bodies, using scaling factors specifically tailored for each respective cutting element pocket 112, significantly more cutting element pockets 112 may be located closer to the desired final locations, as specified by a particular bit body design, after sintering.

While only the positions of the primary cutting element pockets 112 are represented in the tables of FIGS. 6, 7, and 11, the principles of the present invention may be applied to all cutting element pockets 112 of a bit body, including secondary cutting element pockets 112. In other words, a less than fully sintered bit body may be designed and fabricated such that the position of all cutting element pockets, including primary and secondary cutting element pockets, are individually specified using scale factors (e.g., radial and longitudinal) that are specifically determined for each respective cutting element pocket 112.

Figure 13:
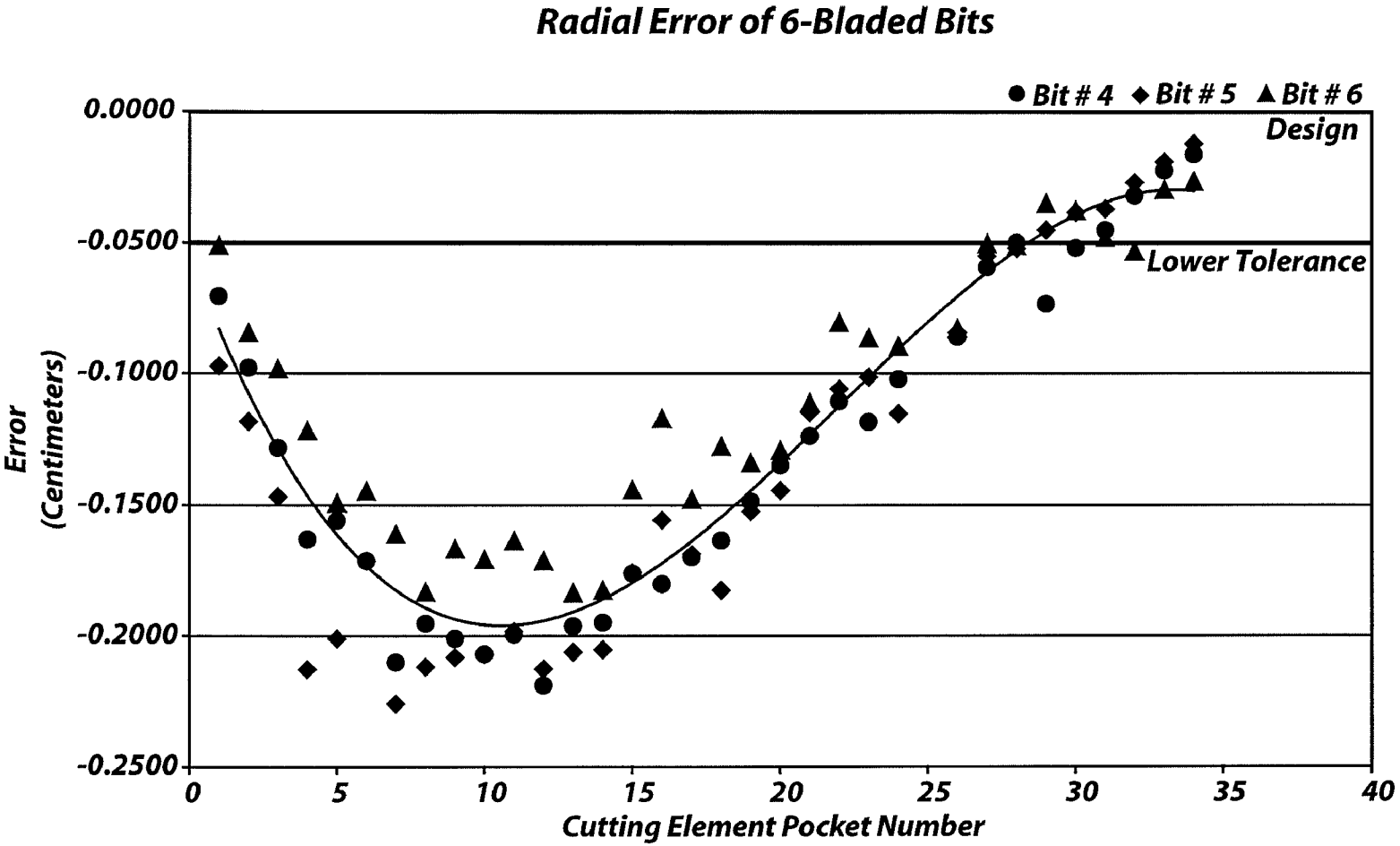
FIGS. 13 and 14 are graphs illustrating radial and longitudinal positional error, respectively, of the primary cutting element pockets of three actual drill bits, each having six blades, in which the cutting element pockets were formed in brown bit bodies at radial and longitudinal positions determined by uniformly scaling the design locations, the brown bit bodies then being sintered to the desired final density.

Furthermore, while the embodiments of the present invention have been described above in relation to a bit body 102 having four blades 116A, 116B, 116C, 116D, the invention is not so limited and the methods of the present invention may be used to form bit bodies having any number of blades. For example, bit bodies having six blades may be fabricated in accordance with the present invention. Three bit bodies (Bit No. 4, Bit No. 5, and Bit No. 6) (not shown) generally similar to the bit body 102 shown in FIGS. 3 and 5, but each having six blades instead of four blades, have been fabricated by sintering less than fully sintered bit bodies to a desired final density. The positions of the cutting element pockets in the less than fully sintered bit bodies were determined by uniformly scaling the cutting element pocket positions from the final desired (i.e., design) positions of the cutting element pockets in the fully sintered bit bodies. In other words, the radial and longitudinal positions of each cutting element pocket in the less than fully sintered bit bodies were determined by scaling the design radial and longitudinal positions by a uniform scale factor. After fabricating the six-bladed bit bodies, the radial position and the longitudinal position of each of the cutting element pockets were measured using a coordinate measurement machine (CMM). FIG. 13 is a graph illustrating the radial error in the position of the cutting element pockets for each of the six-bladed bit bodies, and FIG. 14 is a graph illustrating the longitudinal error in the position of each of the cutting element pockets for each of the six-bladed bit bodies.

Figure 14:
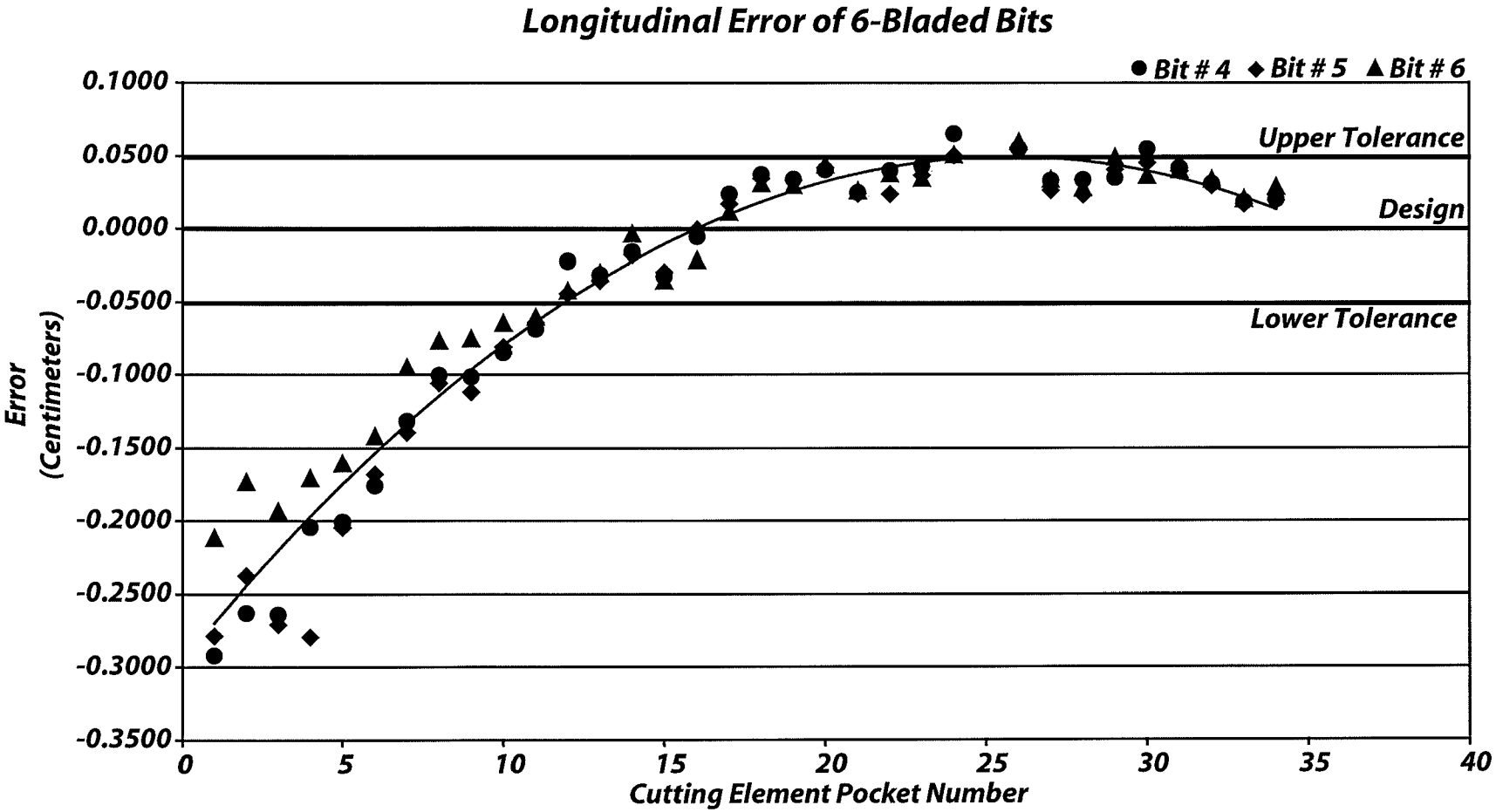

As shown in each of FIGS. 13 and 14, the radial error and the longitudinal error in the actual position of each cutting element pocket from its design or desired final position generally follows a predictable curve or pattern. In particular, the graph of FIG. 13 follows a predictable curve similar to that shown in the graph of FIG. 9 and the graph of FIG. 14 follows a predictable curve similar to that shown in the graph of FIG. 10. Thus, the geometric compensation methods previously described in relation to four-bladed bit bodies for customizing or tailoring the positions of cutting element pockets in less than fully sintered bit bodies are expected to be equally applicable to six-bladed bit bodies, as well as bit bodies having any other number of blades, or even bit bodies that do not include any blades.

The methods of the present invention and earth-boring rotary drill bits and tools formed using such methods may find particular utility in drill bits that include relatively recently developed particle-matrix composite materials. New particle-matrix composite materials are being developed in an effort to improve the performance and durability of earth-boring rotary drill bits. Examples of such new particle-matrix composite materials are disclosed in, for example, in U.S. patent application Ser. No. 11/540,912, filed Sep. 29, 2006, now U.S. Pat. No. 7,913,779, issued Mar. 29, 2011, and pending U.S. patent application Ser. No. 11/593,437, filed Nov. 6, 2006, each assigned to the assignee of the present invention. The entire disclosure of each of these applications is incorporated herein by this reference.

Bit bodies that comprise such recently developed particle-matrix composite materials may be formed using powder compaction and sintering techniques such as those described hereinabove. Therefore, it may be particularly useful to use the methods of the present invention to form bit bodies comprising these recently developed particle-matrix composite materials, although the methods of the present invention may be equally applicable to any bit body that is formed by sintering a less than fully sintered bit body to a desired final density. Furthermore, when sintering bit bodies according to embodiments of the present invention, inserts or displacement members may be provided within one or more of the cutting element pockets, nozzle recesses, fluid courses, and internal longitudinal bores of the bit bodies. For example, inserts or displacement members as disclosed in pending U.S. patent application Ser. No. 11/635,432, filed Dec. 7, 2006, the entire disclosure of which is incorporated herein by the reference, may be provided within such features of the bit bodies during sintering.

While the present invention has been particularly described with respect to the position of cutting element pockets in bit bodies, the invention is equally applicable to features of bit bodies and other earth-boring tools other than cutting element pockets, such as, for example, fluid courses, nozzle recesses, junk slots, blades, etc. Thus, geometric compensation may be used to correct any positional errors due to shrinking of a body during sintering.

Furthermore, the methods of the present invention may be used to form subterranean tools other than fixed-cutter rotary drill bits including, for example, core bits, eccentric bits, bicenter bits, reamers, mills, drag bits, roller cone bits, and other such structures known in the art. For example, methods of using geometric compensation of the present invention may be used to form recesses in bit bodies that are configured to receive so-called "impregnated cutting structures," which may comprise structures formed from a material that includes a matrix material (e.g., tungsten carbide) impregnated with hard particles (e.g., diamond, boron nitride, silicon carbide, silicon nitride, etc.). Such bit bodies and impregnated cutting structures are disclosed in, for example, U.S. Pat. No. 6,843,333 to Richert et al., the disclosure of which is incorporated herein in its entirety by this reference. Furthermore, methods of using geometric compensation of the present invention may be used to form any article of manufacture in which it is necessary or desired to form a geometric feature in a sintered body.

While the present invention has been described herein with respect to certain preferred embodiments, those of ordinary skill in the art will recognize and appreciate that it is not so limited. Rather, many additions, deletions and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A method of forming a bit body of an earth-boring rotary drill bit, the method comprising:

predicting the positional error to be exhibited by at least one feature of a plurality of features in a less than fully sintered bit body upon sintering the less than fully sintered bit body to a desired final density;

forming the at least one feature of the plurality of features on the less than fully sintered bit body at a location at least partially determined by the predicted positional error to be exhibited by the at least one feature of the plurality of features; and sintering the less than fully sintered bit body to a desired final density.

2. The method of claim 1, wherein predicting the positional error to be exhibited by the at least one feature of the plurality of features comprises predicting the positional error to be exhibited by each cutting element pocket of a plurality of cutting element pockets and wherein forming the at least one feature of the plurality of features on the less than fully sintered bit body at the location at least partially determined by the predicted positional error to be exhibited by the at least one feature of the plurality of features comprises forming each cutting element pocket of the plurality of cutting element pockets on the less than fully sintered bit body at a location at least partially determined by the predicted positional error to be exhibited by each cutting element pocket of the plurality of cutting element pockets.

3. The method of claim 1, wherein predicting the positional error to be exhibited by the at least one feature of the plurality of features comprises predicting the positional error to be exhibited by each recess of a plurality of recesses configured to receive a plurality of impregnated cutting structures and wherein forming the at least one feature of the plurality of features on the less than fully sintered bit body at the location at least partially determined by the predicted positional error to be exhibited by the at least one feature of the plurality of features comprises foaming each recess of the plurality of recesses configured to receive a plurality of impregnated cutting structures on the less than fully sintered bit body at a location at least partially determined by the predicted positional error to be exhibited by each recess of the plurality of recesses.

4. The method of claim 1, wherein predicting the positional error to be exhibited by the at least one feature of the plurality of features upon sintering the less than fully sintered bit body to the desired final density comprises:

forming at least one other less than fully sintered bit body;

forming at least one feature in the at least one other less than fully sintered bit body;

sintering the at least one other less than fully sintered bit body to a desired final density to form at least one other fully sintered bit body;

measuring the position of the at least one feature in the at least one other fully sintered bit body; and determining the positional error of the at least one feature in the at least one other fully sintered bit body.

5. A method of forming a bit body of an earth-boring rotary drill bit, the method comprising:

forming at least one less than fully sintered bit body having a plurality of features formed therein;

sintering the at least one less than fully sintered bit body to a desired final density to form at least one fully sintered bit body having a plurality of features formed therein;

measuring the position of each feature of the plurality of features in the at least one fully sintered bit body;

identifying a mathematical expression for estimating a positional error for each feature of the plurality of features in the at least one fully sintered bit body as a function of a variable relating to a position of each feature of the plurality of features in the at least one fully sintered bit body;

using the mathematical expression to determine a location of at least one feature of a plurality of features in a second less than fully sintered bit body;

forming the at least one feature of the plurality of features in the second less than fully sintered bit body at the location determined by the mathematical expression; and sintering the second less than fully sintered bit body to a desired final density.

6. A method of forming a bit body of an earth-boring rotary drill bit, the method comprising:

predicting the positional error to be exhibited by at least one feature of a plurality of features in a less than fully sintered bit body upon sintering the less than fully sintered bit body to a desired final density;

determining a uniform scale factor;

adjusting the uniform scale factor by a number at least partially determined by the predicted positional error;

forming the at least one feature of the plurality of features on the less than fully sintered bit body at a location determined by the adjusted uniform scale factor; and sintering the less than fully sintered bit body to a desired final density.

7. A method of forming a bit body of an earth-boring rotary drill bit, the method comprising:

designing a bit body having a design drilling profile;

forming a drilling profile of a less than fully sintered bit body to have a shape differing from a shape of the design drilling profile; and sintering the less than fully sintered bit body to a desired final density to form the bit body.

8. The method of claim 7, further comprising:

predicting a positional error to be exhibited by at least one cutting element pocket upon sintering the less than fully sintered bit body to the desired final density; and forming the at least one cutting element pocket at a location at least partially determined by the predicted positional error to be exhibited by the at least one cutting element pocket.

9. The method of claim 8, wherein predicting the positional error to be exhibited by at the least one cutting element pocket upon sintering the less than fully sintered bit body to the desired final density comprises empirically determining the predicted positional error.

10. A method of forming a bit body of an earth-boring rotary drill bit, the method comprising:

designing a fully sintered bit body having a design drilling profile;

forming a drilling profile of a less than fully sintered bit body to have a shape differing from a shape of the design drilling profile;

fabricating at least one other fully sintered bit body substantially similar to the fully sintered bit body from at least one other less than fully sintered bit body having at least one cutting element pocket located thereon at a position determined using a uniform position scale factor;

measuring a positional error for the at least one cutting element pocket in the at least one other fully sintered bit body after sintering the at least one other less than fully sintered bit body to a desired final density to form the at least one other fully sintered bit body;

forming at least one cutting element pocket in the less than fully sintered bit body at a location at least partially determined by the measured positional error for the at least one cutting element pocket in the at least one other fully sintered bit body; and sintering the less than fully sintered bit body to a desired final density.

11. A method of forming a bit body of an earth-boring rotary drill bit, the method comprising:

designing a bit body having a design drilling profile;

forming a drilling profile of a less than fully sintered bit body to have a shape differing from a shape of the design drilling profile;

empirically determining a predicted positional error to be exhibited by at least one cutting element pocket upon sintering the less than fully sintered bit body to a desired final density;

adjusting a uniform scale factor by a number at least partially determined by the predicted positional error to specify a specific scale factor;

using the specific scale factor to form the at least one cutting element pocket at a location at least partially determined by the predicted positional error to be exhibited by the at least one cutting element pocket; and sintering the less than fully sintered bit body to a desired final density.

12. A method of designing a less than fully sintered bit body for an earth-boring rotary drill bit, the method comprising:

estimating a positional error for each feature of a plurality of features of a bit body upon sintering the less than fully sintered bit body to a desired final density to form the bit body; and specifying a location for each feature of the plurality of features in a design for the less than fully sintered bit body at least partially in consideration of the respective estimated positional error for each feature of the plurality of features.

13. The method of claim 12, wherein estimating the positional error for each feature of the plurality of features comprises estimating a positional error for each cutting element pocket of a plurality of cutting element pockets.

14. The method of claim 13, wherein estimating the positional error for each cutting element pocket of the plurality of cutting element pockets comprises estimating a radial positional error and a longitudinal positional error for each cutting element pocket of the plurality of cutting element pockets.

15. The method of claim 13, further comprising specifying a location for each cutting element pocket of the plurality of cutting element pockets in the design for the less than fully sintered bit body using a plurality of non-uniform positional scaling factors.

16. A method of designing a less than fully sintered bit body for an earth-boring rotary drill bit, the method comprising:

estimating a positional error for each cutting element pocket of a plurality of cutting element pockets in a bit body upon sintering a less than fully sintered bit body to a desired final density to form the bit body; and specifying a location for each cutting element pocket of the plurality of cutting element pockets in the design for the less than fully sintered bit body using specific positional scaling factors determined using the estimated positional error for each respective cutting element pocket of the plurality of cutting element pockets.

17. A less than fully sintered bit body of an earth-boring rotary drill bit, the less than fully sintered bit body comprising a drilling profile having a shape differing from a desired shape of a design drilling profile of a fully sintered bit body to be formed from the less than fully sintered bit body.

18. The less than fully sintered bit body of claim 17, further comprising a plurality of cutting element pockets, the plurality of cutting element pockets located at non-uniformly scaled positions on the less than fully sintered bit body relative to the desired final positions of the cutting element pockets on a fully sintered bit body to be formed by sintering the less than fully sintered bit body to a desired final density.

19. A less than fully sintered bit body of an earth-boring rotary drill bit comprising:

at least one recess located at a position on a face of the bit body scaled by a first factor from a design position for the at least one recess; and at least a second recess located at a position on the face of the bit body scaled by a second factor from a design position for the at least a second recess, the second factor differing from the first factor.

20. The less than fully sintered bit body of claim 19, wherein the less than fully sintered bit body comprises a drilling profile having a shape differing from a desired shape of a design drilling profile of the fully sintered bit body to be formed from the less than fully sintered bit body.

21. The less than fully sintered bit body of claim 19, wherein the less than fully sintered bit body comprises a plurality of hard particles dispersed throughout a matrix material.

22. The less than fully sintered bit body of claim 19, wherein the at least one recess and the at least a second recess each comprise cutting element pockets.

* * * * *

UNITED STATES PATENT AND TRADEMARK OFFICE

CERTIFICATE OF CORRECTION

PATENT NO. : 8,079,429 B2
APPLICATION NO. : 12/133245
DATED : December 20, 2011
INVENTOR(S) : Redd H. Smith et al.

It is certified that error appears in the above-identified patent and that said Letters Patent is hereby corrected as shown below:

In the specification:

| | | | |
|---|---|---|---|
| | COLUMN 5, | LINE 18, | change “is graph” to --is a graph-- |
| | COLUMN 5, | LINE 24, | change “is graph” to --is a graph-- |

In the claims:

| | | | |
|---|---|---|---|
| CLAIM 3, | COLUMN 15, | LINE 36, | change “foaming” to --forming-- |
| CLAIM 9, | COLUMN 16, | LINE 44, | change “by at the least” to --by the at least-- |

Signed and Sealed this
Tenth Day of February, 2015

Michelle K. Lee

Michelle K. Lee
*Deputy Director of the United States Patent and Trademark Office*